US006691486B1

(12) United States Patent
Durand

(10) Patent No.: US 6,691,486 B1
(45) Date of Patent: Feb. 17, 2004

(54) REINFORCEMENT FOR CONCRETE WALL

(76) Inventor: Philippe Durand, 37, rue Veuve Fleuret, 78130 Les Mureaux (FR)

( * ) Notice: Subject to any disclaimer, the term of this patent is extended or adjusted under 35 U.S.C. 154(b) by 0 days.

(21) Appl. No.: 10/110,190

(22) PCT Filed: Oct. 20, 2000

(86) PCT No.: PCT/FR00/02932

§ 371 (c)(1),
(2), (4) Date: May 24, 2002

(87) PCT Pub. No.: WO01/29346

PCT Pub. Date: Apr. 26, 2001

(30) Foreign Application Priority Data

Oct. 22, 1999 (FR) ..... 99 13463

(51) Int. Cl.[7] ..... E04C 5/00
(52) U.S. Cl. ..... 52/645; 52/649.1; 52/660
(58) Field of Search ..... 52/649.1, 562, 52/426, 428, 654.1, 660, 645

(56) References Cited

U.S. PATENT DOCUMENTS

| | | | | | |
|---|---|---|---|---|---|
| 1,684,195 | A | * | 9/1928 | Olmsted | 52/649.1 |
| 2,389,238 | A | * | 11/1945 | Phillips | 52/649.1 |
| 3,347,007 | A | * | 10/1967 | Hale | 52/380 |
| 3,559,355 | A | * | 2/1971 | Day, Jr. | 52/251 |
| 3,721,058 | A | * | 3/1973 | Dewey et al. | 52/251 |
| 3,844,083 | A | * | 10/1974 | Farley, Jr. | 52/645 |
| 4,104,842 | A | * | 8/1978 | Rockstead et al. | 52/649.1 |
| 4,336,676 | A | * | 6/1982 | Artzer | 52/309.7 |
| 4,366,657 | A | * | 1/1983 | Hopman | 52/405.1 |
| 5,398,470 | A | * | 3/1995 | Ritter et al. | 52/309.11 |
| 5,528,876 | A | * | 6/1996 | Lu | 52/654.1 |
| 5,687,522 | A | * | 11/1997 | Durand et al. | 52/414 |
| 6,231,024 | B1 | * | 5/2001 | Kugimiya et al. | 249/33 |
| 6,295,770 | B1 | * | 10/2001 | Sheu et al. | 52/167.1 |

FOREIGN PATENT DOCUMENTS

| | | |
|---|---|---|
| DE | 29602697 | 11/1996 |
| WO | 9325776 | 12/1993 |
| WO | 9731165 | 8/1997 |

* cited by examiner

*Primary Examiner*—Brian E. Glessner
(74) *Attorney, Agent, or Firm*—Dennison, Schultz, Dougherty & MacDonald

(57) ABSTRACT

A reinforcement includes two parallel walls formed with braces arranged along two orthogonal directions, the walls being spaced apart by tie rods. The structure further includes on at least one of its formwork surfaces a permeable structure for retaining aggregate and allowing excess water of cast concrete to escape. According to the invention, at least one of the parallel walls includes two mutually independent grates, one the grates being associated with the other wall by a first set of tie rods, and the other of the grates being associated with the other wall by a second set of tie rods, independent of the first set. When the grates are displaced in opposite directions along an axis parallel to the plane of the grates, the spacing between the walls is modified.

7 Claims, 7 Drawing Sheets

REINFORCEMENT FOR CONCRETE WALL

BACKGROUND OF THE INVENTION

The invention concerns a reinforcement for a concrete wall.

It also concerns the use of said reinforcement in a sacrifice formwork.

Before concrete casting, the embodiment of the cast concrete wall requires delimiting the volume into which the material is to be cast by means of formwork walls.

So as to reinforce the resistance of the walls, concrete irons are housed therein by known means and which, when assembled together, form a reinforcement.

Generally speaking, the technique consists of fixing said reinforcements on site or even outside the site, but there remains the problem of transport which increases the cost as these reinforcements are therefore bulky.

Although the concrete casting technique by means of formwork sheetings is widely used, for some years now the technique of sacrifice filtering formwork appeared on the market.

This technique has the advantage of allowing the excess water to escape from the concrete.

In fact, with a filtering wall, the concrete contained in the formwork no longer behaves as a fluid creating a hydrostatic pressure, which is proportional to the height of the cast concrete above the level in question, and owing to this the forces expanded by said concrete are much weaker.

This makes it possible to use light formworks which can be installed without having to use a lifting gear.

In currently known embodiments, said filtering formwork appears in the form of two walls:

obtained by assembling permeable panels retaining the aggregate and allowing the water to escape, the panels being thus made of expanded metal and, kept at the required space by tie rods which, when the formwork is in place, extend into planes perpendicular to the formwork surfaces.

So as to allow transport of said sacrifice formworks, the tie rods are joined to the formwork walls by joints so that when one of the formwork walls is moved translation, all the tie rods fold down on a given side.

In reality, the tie rods are associated with stiffeners to which the expanded metal panels are secured.

According to the shape of the tie rods, it is possible to make said tie rods participate in the resistance of the cast wall in particular by creating a hooping effect, but mainly inside a plane perpendicular to the plane in which said tie rod extends.

SUMMARY OF THE INVENTION

The aim of the invention is to increase the resistance of the walls.

The invention also aims at improving the performances of said sacrifice formworks of the above mentioned type.

To this effect, the purpose of the invention is to provide a reinforcement for a concrete wall comprising a bearing structure made up of two parallel walls, each formed of braces arranged along two orthogonal directions and said walls being suitably maintained spaced apart by tie rods, this reinforcement being characterised in that:

one of the two parallel walls consists of two mutually independent grates, one of the two independent grates is associated with the other wall by a first set of tie rods, and the other grate of said wall is also associated with the other wall by a second set of tie rods independent of those of the first set so that when the grates are moved in the opposite direction and along an axis parallel to the plane of the grates, the spacing between the walls is modified.

It also concerns the use of this reinforcement.

BRIEF DESCRIPTION OF THE DRAWINGS

The invention shall be more readily understood on reading the following description given by way of non-restrictive example with reference to the accompanying drawing which diagrammatically represents.

DESCRIPTION OF THE PREFERRED EMBODIMENTS

Figure 1:
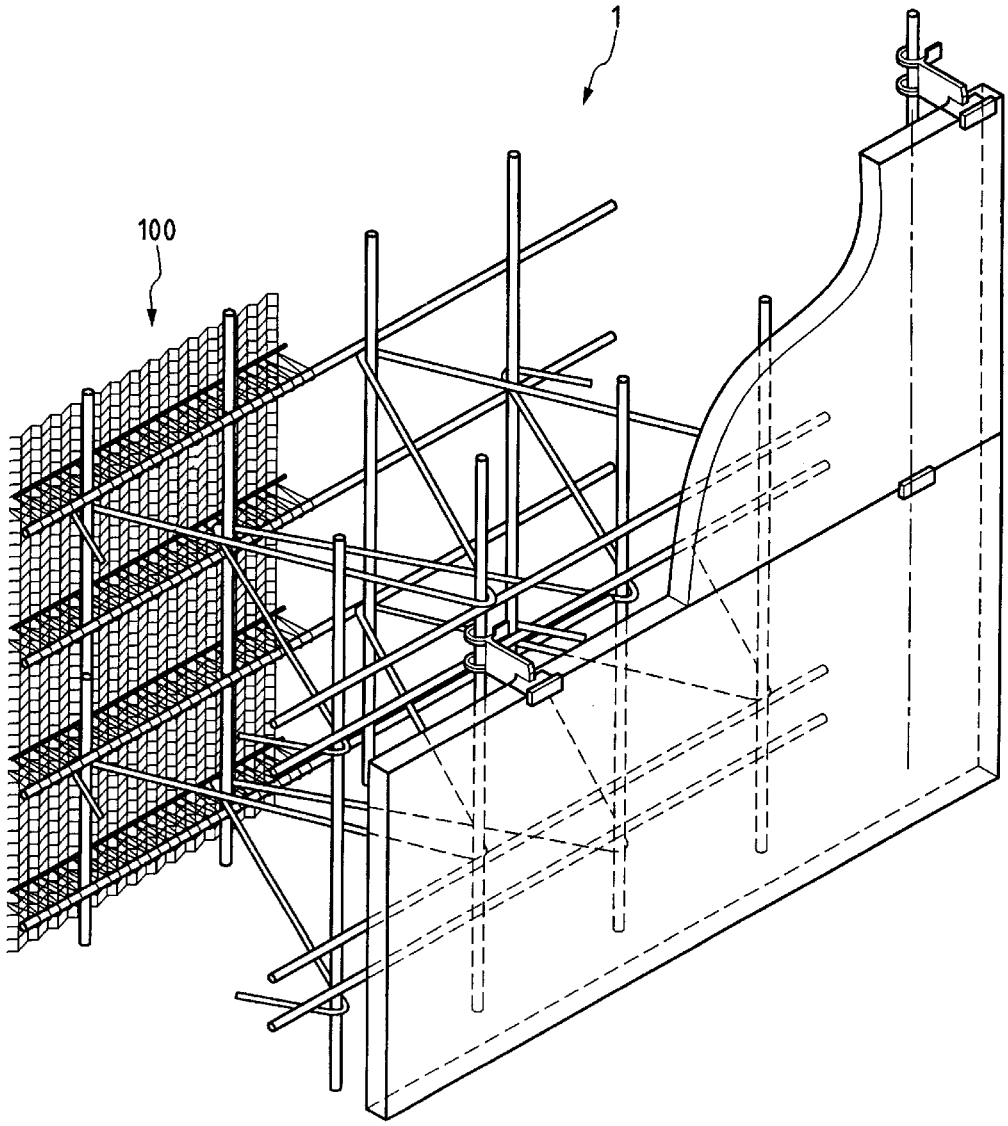
FIGS. 1 and 2: views of a structure in a useable position.
Figure 2:
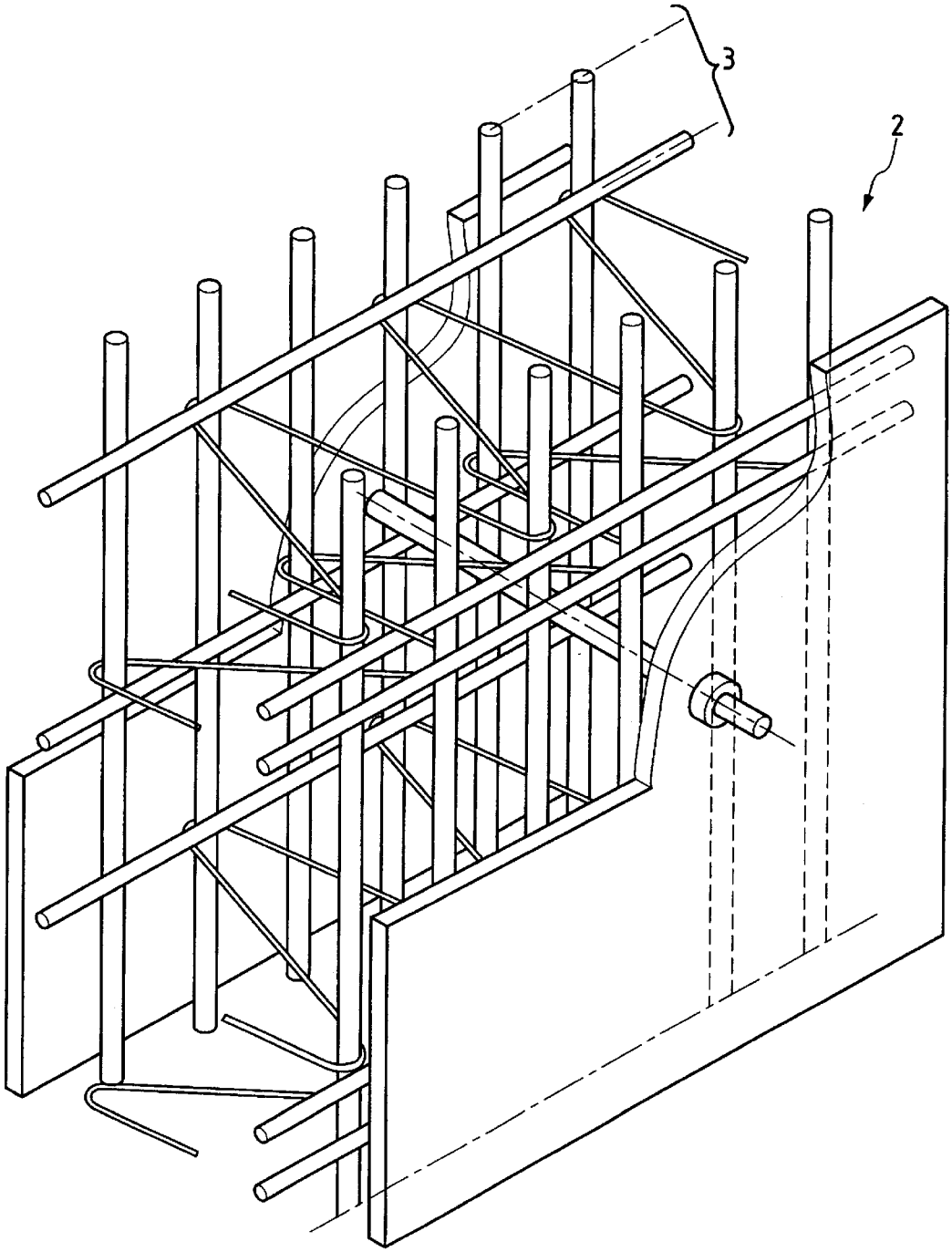
Figure 3:
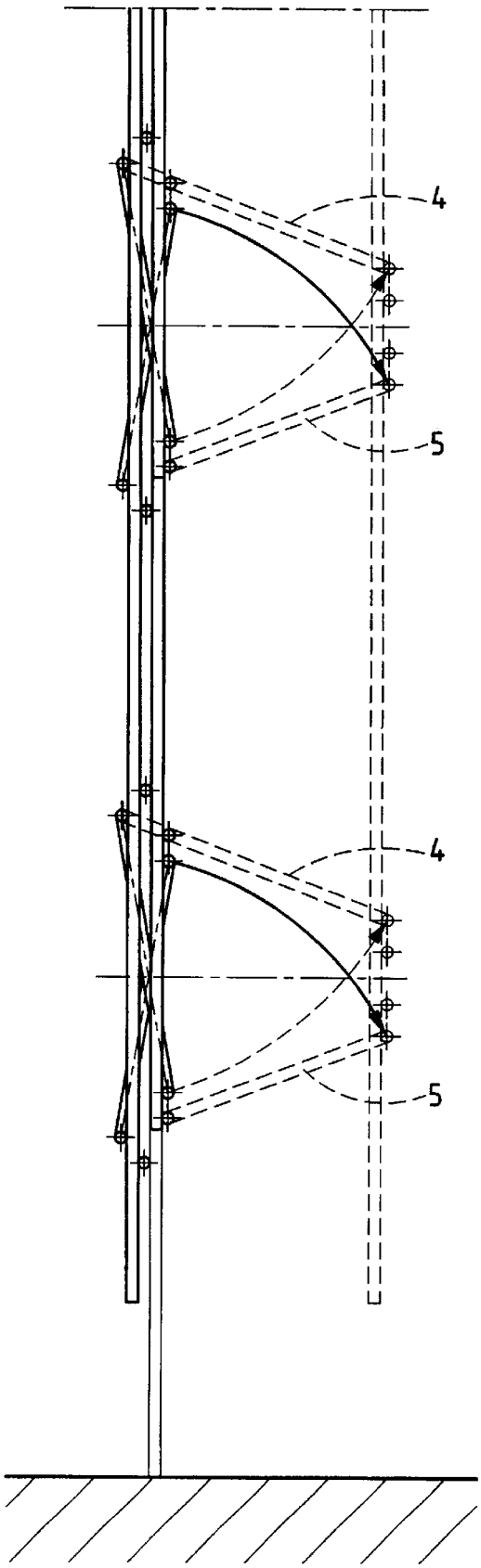
FIG. 3: a side view of a formwork showing the positioning kinetics.
Figure 4:
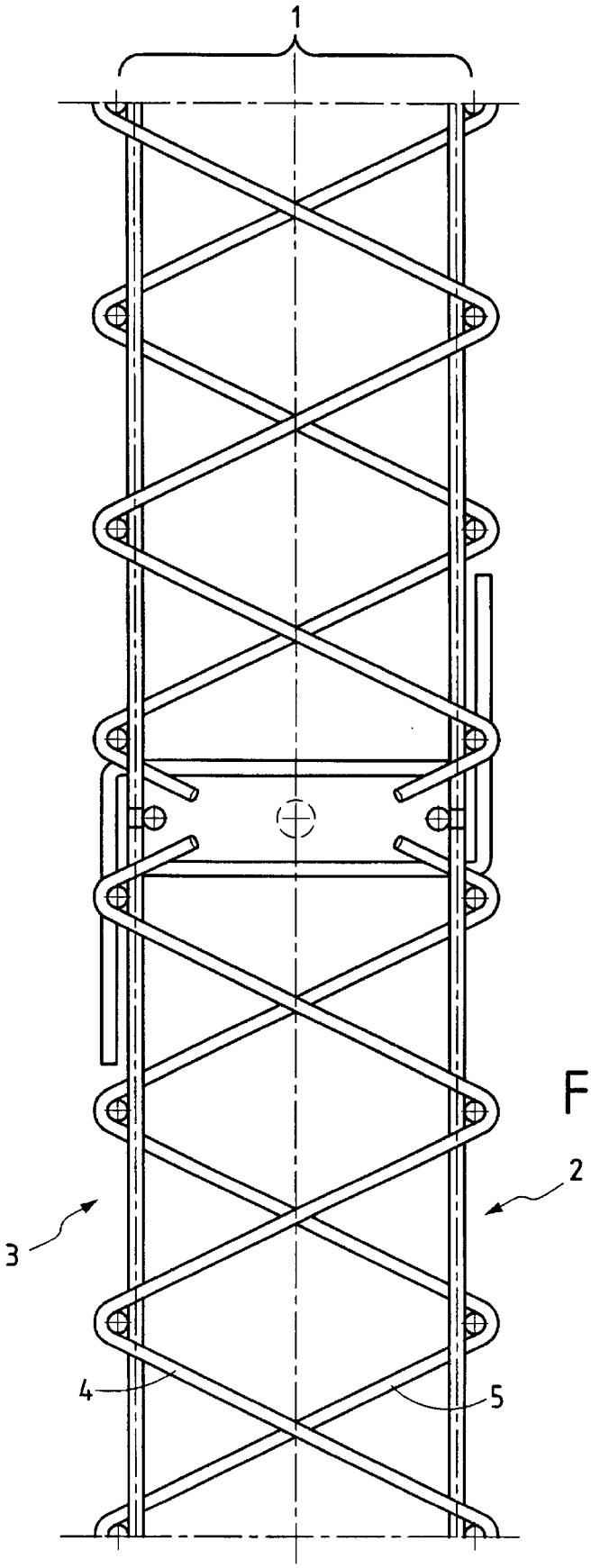
FIG. 4: a top view of a formwork.

With reference to the drawing, the latter shows a reinforcement 1 for reinforcing a concrete wall.

It also shows a filtering sacrifice formwork.

Said formwork can be used to obtain vertical or horizontal walls.

Said formwork conventionally includes a bearing structure 1 comprising two parallel walls 2, 3 each formed with braces arranged along two orthogonal directions and said walls 2, 3 are maintained spaced apart by tie rods 4, 5.

When using said reinforcement as a filtering wall sacrifice formwork structure 100, said reinforcement further comprises on at least one of its formwork surfaces a permeable structure retaining the aggregate and allowing the excess water to escape from the cast concrete.

According to another variant, at least one of the formwork walls is impermeable.

According to one characteristic of the invention one (2) of the two parallel walls 2, 3 is made up of two mutually independent walls, one (2A) of the two independent grates 2A, 2B is associated with the other wall 3 by a first set of tie rods 4, and the other grate 2B of said wall is also associated with the other wall 3 by a second set of tie rods (5) independent of those (4) of the first set so that on moving the grates in the opposite direction and along an axis parallel to the plane of the grates, the spacing between the walls is modified.

Advantageously:

the tie rods 4 of the first set of tie rods extend into first planes parallel and slanted with respect to a plane perpendicular to the two parallel walls, the tie rods 5 of the second set of tie rods also extend into second planes parallel and slanting with respect to a plane perpendicular to the two parallel walls, said first and second planes are intersecting and alternate.

Said formwork is therefore foldable despite the orientation of the tie rods which, when the bearing structure is in an unfolded position, constitute a triangulated structure.

The tie rods 4, 5 are for example obtained by folding a wire zigzag which hooks behind some of the rods of the grate.

The hooking points of the wires folded zigzag of the first set of tie rods are, as regards one wall, materialised by the rods or braces with even numbers, whereas the hooking points of the wires folded zigzag of the second set of tie rods are, as regards the same wall, materialised by rods with odd numbers.

Thus, seen from above, the zigzag wires delimit rhombuses and half-rhombuses.

The two grates 2A, 2B are maintained at a predetermined distance by associations means 10, said association means including means for guiding in translation the two grates inside a plane parallel to said two grates.

Said associations means 10 are for example constituted by a retaining element or elastic pin forming around the rod two hooks 11, 12 or loops joined by an elastic blade 13 which, by reacting on a transversal rod, maintains the rods and rods and/or tie rods.

The tie rods are thus embodied by spring steel pins.

The shape of the springs is such so as to expand the action and reaction forces on each of the horizontal and vertical reinforcements.

When in contact with the bars, these stresses develop a friction force proportional to the stiffness of the clip-springs.

It is to be noted that this friction force is considerably increased when using a "Tor" bar owing to the presence of the roughness of these clip-springs.

Figure 6:
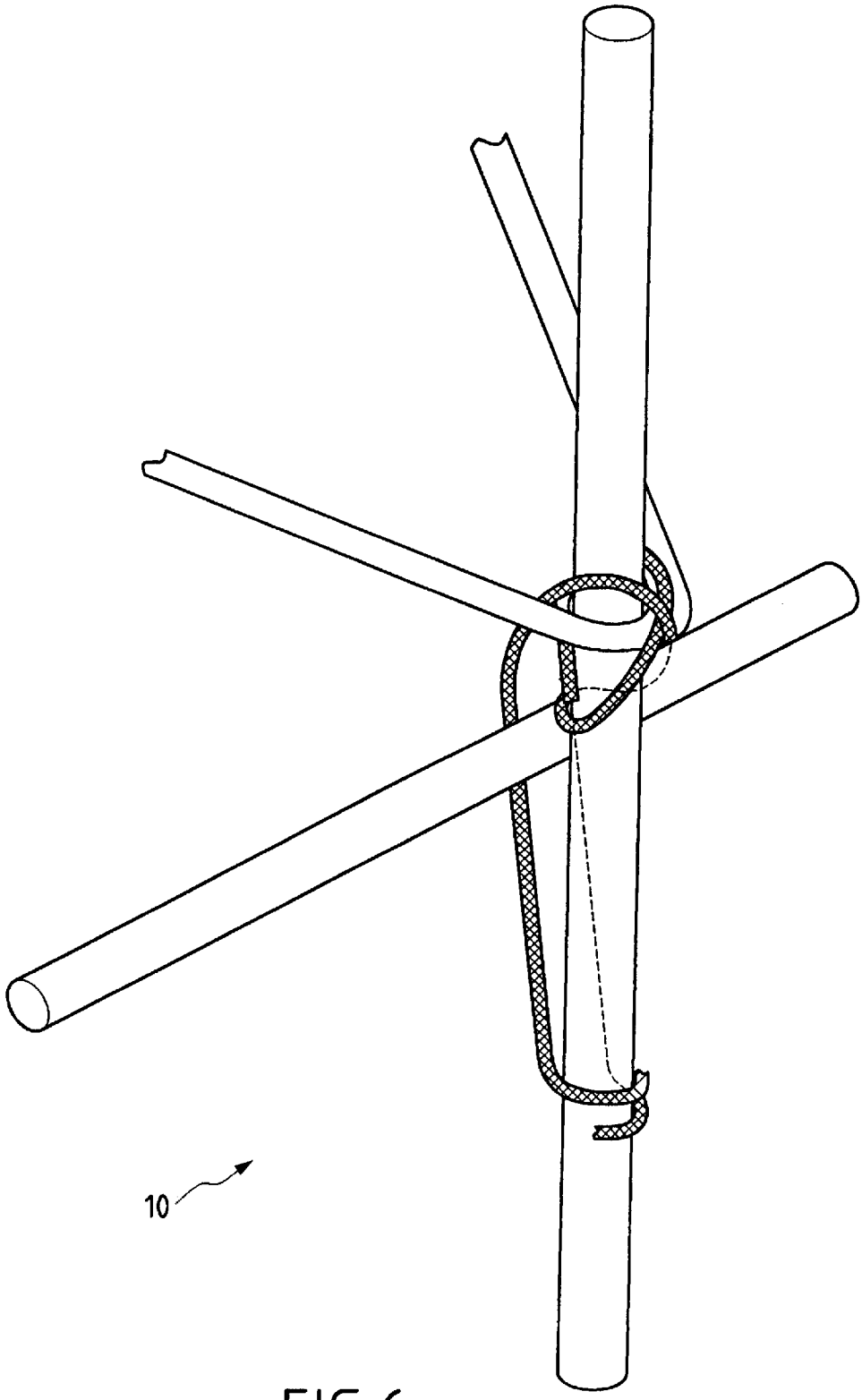
Figure 7:
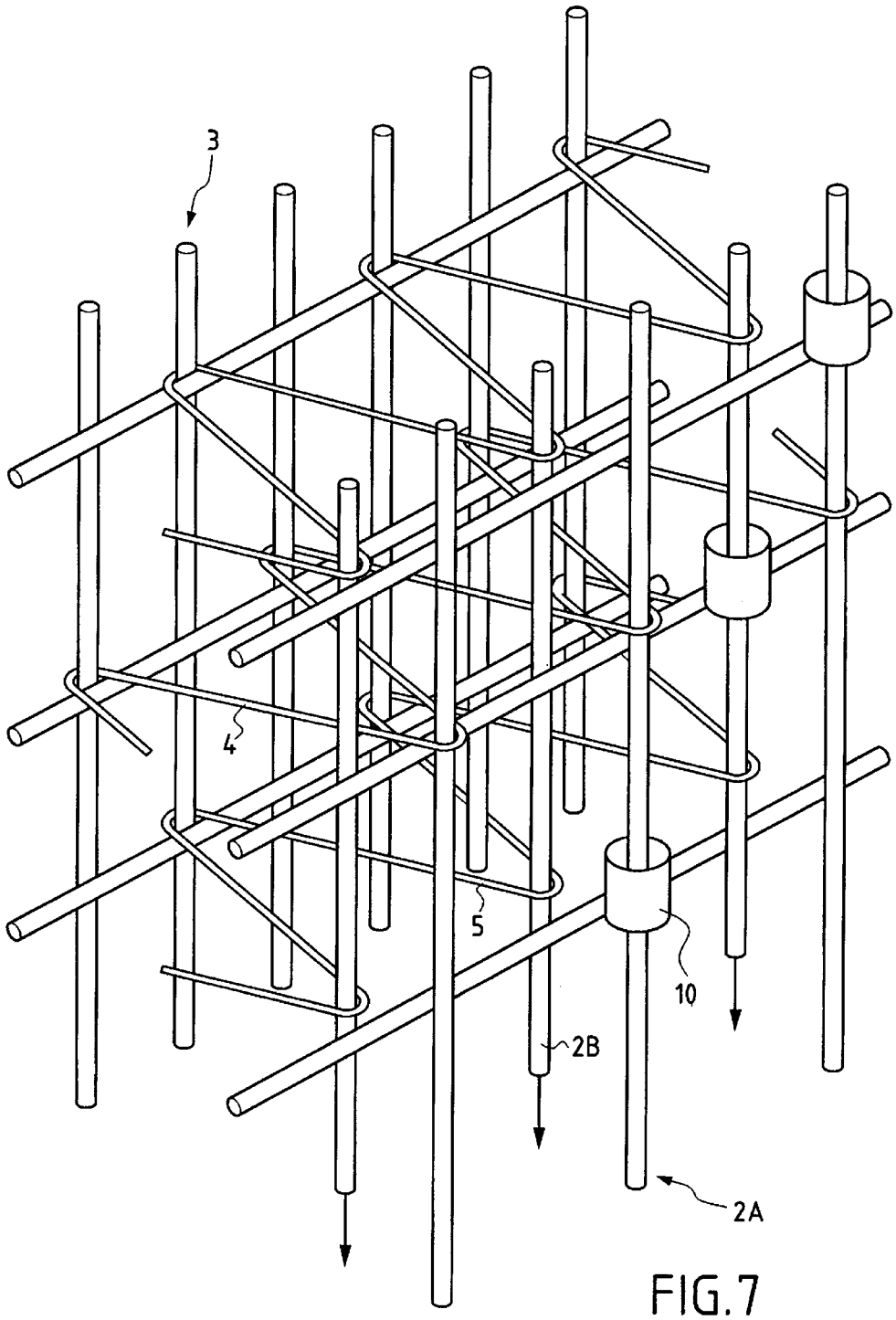
FIG. 7: a perspective view showing the kinetics.

FIG. 6 shows an embodiment example of locking clips for horizontal and vertical/hook reinforcements.

Figure 5:
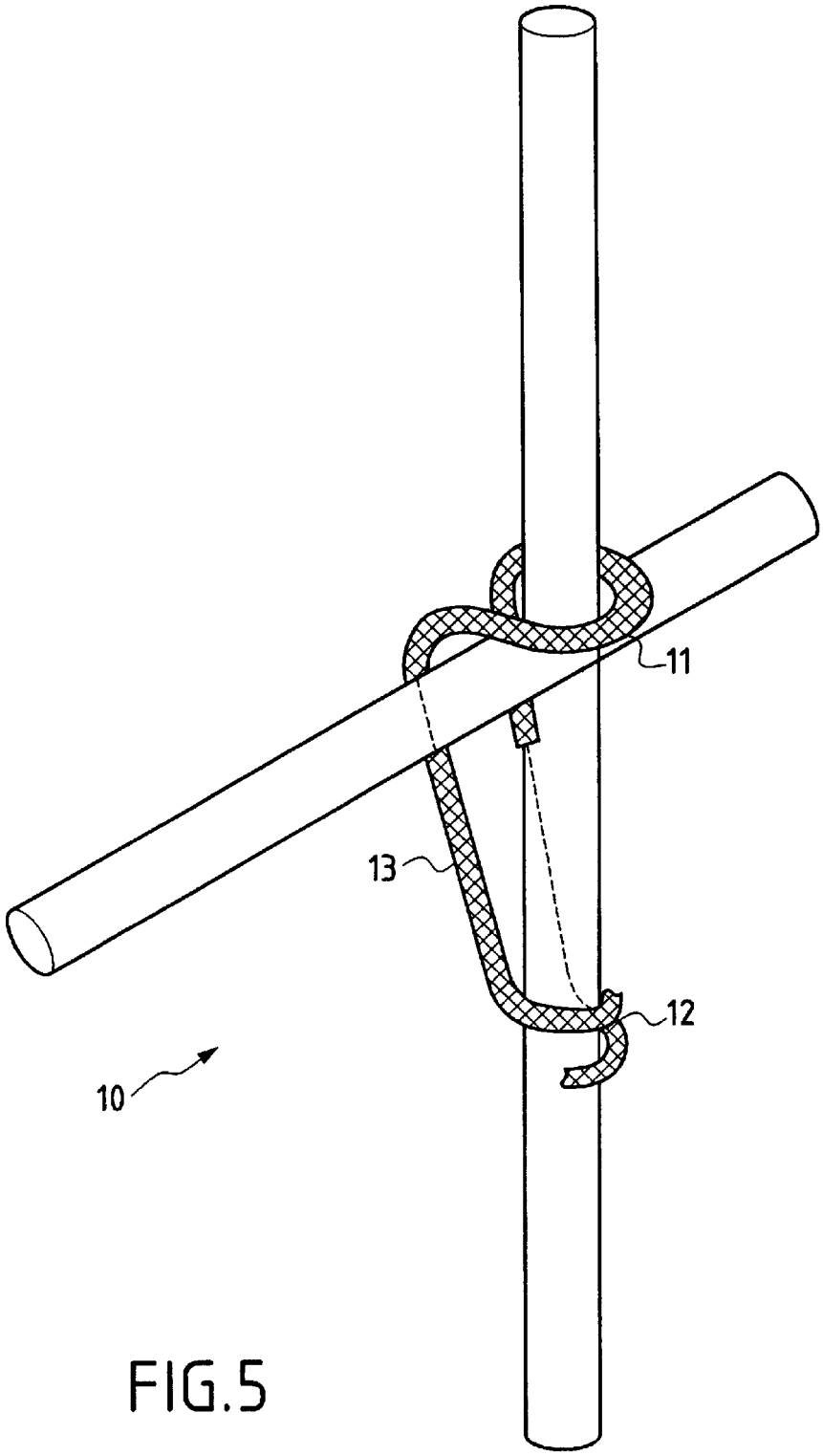
FIGS. 5 and 6: embodiments details.

FIG. 5 shows an embodiment example of locking clips for vertical and horizontal reinforcements.

What is claimed is:

1. Reinforcement for a concrete wall comprising first and second parallel walls, each formed of braces arranged along two orthogonal directions, said parallel walls being spaced apart by tie rods, said reinforcement further comprising on at least one formwork surface a permeable structure for retaining aggregate and allowing excess water to escape from cast concrete, said first wall being formed of two independent grates, one of said independent grates being associated with the second wall by a first set of tie rods, and the other of said independent grates being associated with the second wall by a second set of tie rods independent from the tie rods of the first set, said grates being independently movable in opposite directions along an axis parallel to the plane of the grates, whereby spacing between the first and second walls may be modified.

2. Reinforcement according to claim 1, wherein:

the tie rods of the first set extend into first parallel planes and are slanted with respect to a plane perpendicular to the two parallel walls, and the tie rods of the second set also extend into second parallel planes and are slanted with respect to a plane perpendicular to the two parallel walls, the first and second planes being collectively intersecting and alternate.

3. Reinforcement according to claim 1, wherein the tie rods are formed by folding a wire zigzag and hooking behind some bars of the grate.

4. Reinforcement according to claim 3, wherein the wire of the first set of tie rods is hooked at points for one wall materialized by a first set of bars or braces, and the wire of the second set of tie rods is hooked at points which are for the same wall materialized by the bars a second and alternating set of bars or braces.

5. Reinforcement according to claim 1, wherein the two grates are maintained at a predetermined distance by association means which include means for guiding in translation the two grates inside a plane parallel to the two grates.

6. Reinforcement according to claim 5, wherein the association means comprise a retaining element of an elastic pin forming around the bar two hooks or hoops joined by an elastic blade, which, via reaction of a transversal bar, maintains the rods.

7. Sacrificial formwork including on at least one formwork surface thereof a permeable structure for retaining aggregate and allowing excess water to escape from cast concrete, said formwork comprising a reinforcement according to claim 1.

* * * * *